US006116918A

United States Patent [19]

Tseng et al.

[11] Patent Number: 6,116,918

[45] Date of Patent: Sep. 12, 2000

[54] HIGH PIN DENSITY CONNECTOR AND A TOOL FOR FACILITATING MOUNTING THE CONNECTOR TO A CIRCUIT BOARD

[75] Inventors: Hans Tseng, Cupertino, Calif.; Hsiang-Ping Chen, Lu-Chou, Taiwan

[73] Assignee: Hon Hai Precision Ind. Co., Ltd., Taipei Hsien, Taiwan

[21] Appl. No.: 09/218,729

[22] Filed: Dec. 22, 1998

[30] Foreign Application Priority Data

Dec. 31, 1997 [TW] Taiwan ..... 86221851

[51] Int. Cl.[7] ..... H01R 12/00

[52] U.S. Cl. ..... 439/79; 439/80; 29/739

[58] Field of Search ..... 439/79, 80, 943; 29/739

[56] References Cited

U.S. PATENT DOCUMENTS 4,955,819 9/1990 Harting et al. ..... 439/79
5,252,080 10/1993 Pesson ..... 439/79
5,276,962 1/1994 Harting et al. ..... 29/837
5,896,649 4/1999 Millhimes et al. ..... 29/739
6,038,762 3/2000 Clark et al. ..... 29/739

*Primary Examiner*—Brian Sircus
*Assistant Examiner*—Michael C. Zarroli
*Attorney, Agent, or Firm*—Wei Te Chung

[57] ABSTRACT

A high pin density connector includes an insulative housing defining a plurality of passageways for receiving a corresponding number of contacts therein for interferentially engaging with holes defined in a PCB. A positioning block attached to the housing forms a bearing face for receiving a force from an external tool for facilitating insertion of the contacts into the corresponding holes of the PCB. Guiding means comprises two grooves defined in the bearing face of the positioning block and ribs formed on a bottom face of the tool. The tool engages with the positioning block by inserting the ribs into the corresponding grooves. When a user exerts a force on the tool, the force is evenly distributed along the positioning block whereby all of the contacts are properly received in the corresponding holes of the PCB.

4 Claims, 6 Drawing Sheets

HIGH PIN DENSITY CONNECTOR AND A TOOL FOR FACILITATING MOUNTING THE CONNECTOR TO A CIRCUIT BOARD

BACKGROUND OF THE INVENTION

1. Field of the Invention

The present invention relates to a high pin density connector, and particularly to a high pin density connector having guiding means for properly engaging an external tool whereby a user exerts a force on the tool to facilitate insertion of contacts of the connector into holes defined in a PCB.

2. The Prior Art

As the trend of the computer industry continues toward miniaturization, high pin density connectors are becoming increasingly popular for reducing occupied space on a printed circuit board. A conventional high pin density connector 1 is shown in FIGS. 1, 2A, and 2B. The connector 1 includes an insulative housing 11 having a mating face 111 and a mounting face 112 opposite the mating face 111. A plurality of passageways 113 are defined through the housing 11 between the mating and mounting faces 111, 112 for receiving contacts 12 therein. The contacts 12 extend downwards for an interferential fit with holes 31 defined in a PCB 3. After the contacts 12 are aligned with the corresponding holes 31 of the PCB 3, a tool 2 is placed on a bearing face 114 of the housing 11. A user exerts a force on the tool 2 in the direction indicated by the arrow in FIG. 2A, whereby the contacts 12 are inserted into the corresponding holes 31 of the PCB 3 as seen in FIG. 2B.

Since the tool 2 merely abuts the bearing face 114 of the housing 11 and no engagement exists therebetween, the tool 2 may slide along the bearing face 114 whereby the force exerted thereon may not be evenly distributed to the contacts 12. Thus, the contacts 12 may become misaligned with respect to the holes 31 defined in the PCB 3. As the force is continually exerted on the tool 2, the contacts 12 may become deformed thereby rendering the connector 1 inoperable.

Hence, an improved high pin density connector is needed to overcome the disadvantages of conventional connectors.

SUMMARY OF THE INVENTION

Accordingly, an objective of the present invention is to provide guiding means between a tool and a high pin density connector for facilitating insertion of contacts of the connector into a PCB.

Another objective of the present invention is to provide a high pin density connector with a tool for evenly distributing an insertion force across a surface of the connector for facilitating insertion of contacts of the connector into a PCB.

To fulfill the above mentioned objectives, a high pin density connector in accordance with the present invention includes an insulative housing defining a plurality of passageways for receiving a corresponding number of contacts therein for an interferential engagement with holes defined in a PCB. A positioning block attached to the housing forms a bearing face for receiving a force from an external tool for facilitating insertion of the contacts into the corresponding holes of the PCB. Guiding means comprises two grooves defined in the bearing face of the positioning block and ribs formed on a bottom face of the tool. The tool engages with the positioning block by inserting the ribs into the corresponding grooves. When a user exerts a force on the tool, the force is evenly distributed across the positioning block whereby all of the contacts are properly received in the corresponding holes of the PCB.

These and additional objects, features, and advantages of the present invention will become apparent after reading the following detailed description of the preferred embodiment of the present invention taken in conjunction with the appended drawing figures.

DETAILED DESCRIPTION OF THE PREFERRED EMBODIMENT

Reference will now be made in detail to the preferred embodiment of the present invention.

Figure 1:
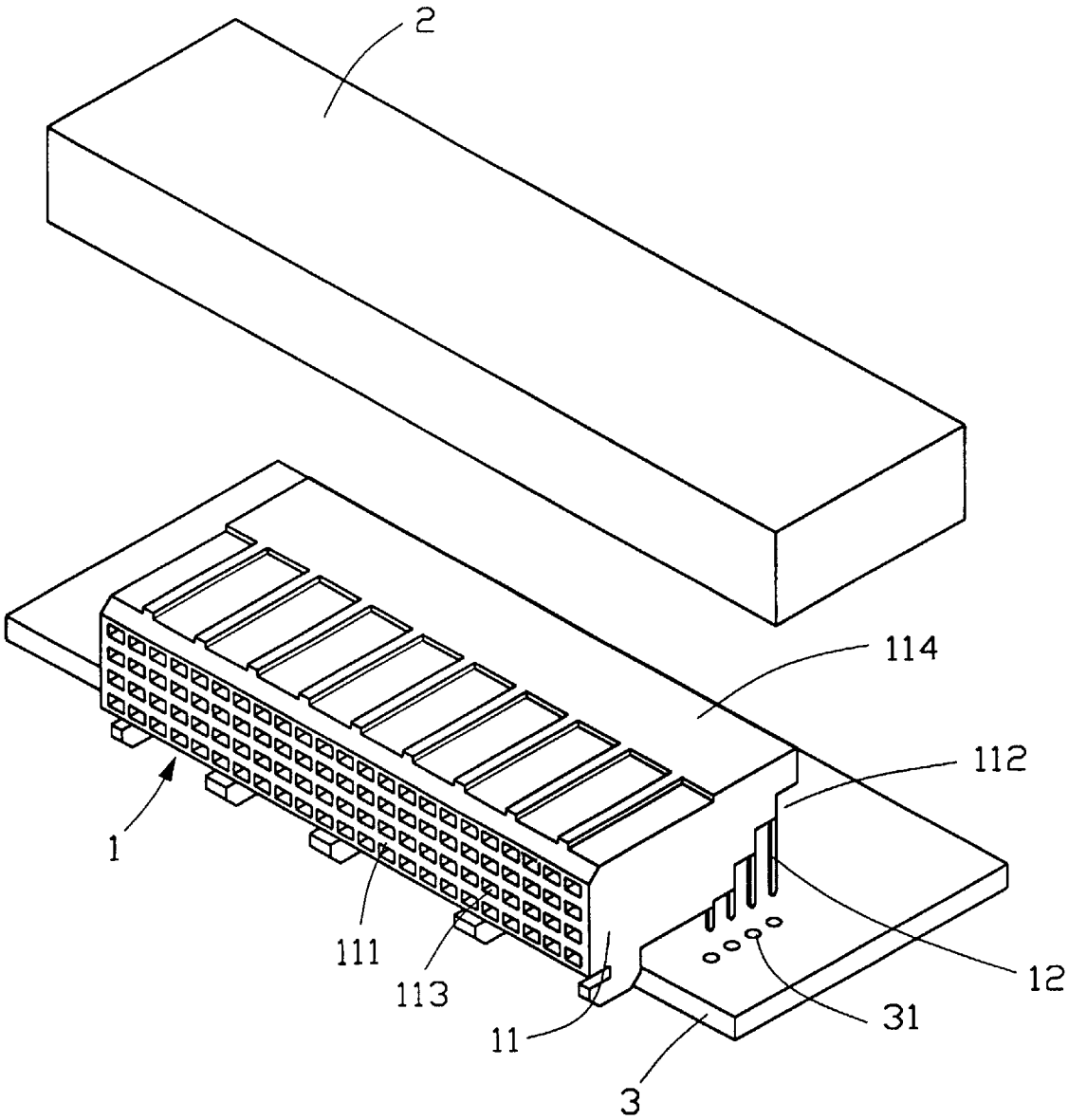
FIG.1 (PRIOR ART)
FIG. 1 is a perspective view showing a conventional high pin density connector and an external tool for providing a force to insert contacts of the connector into holes defined in a PCB.
Figure 2A:
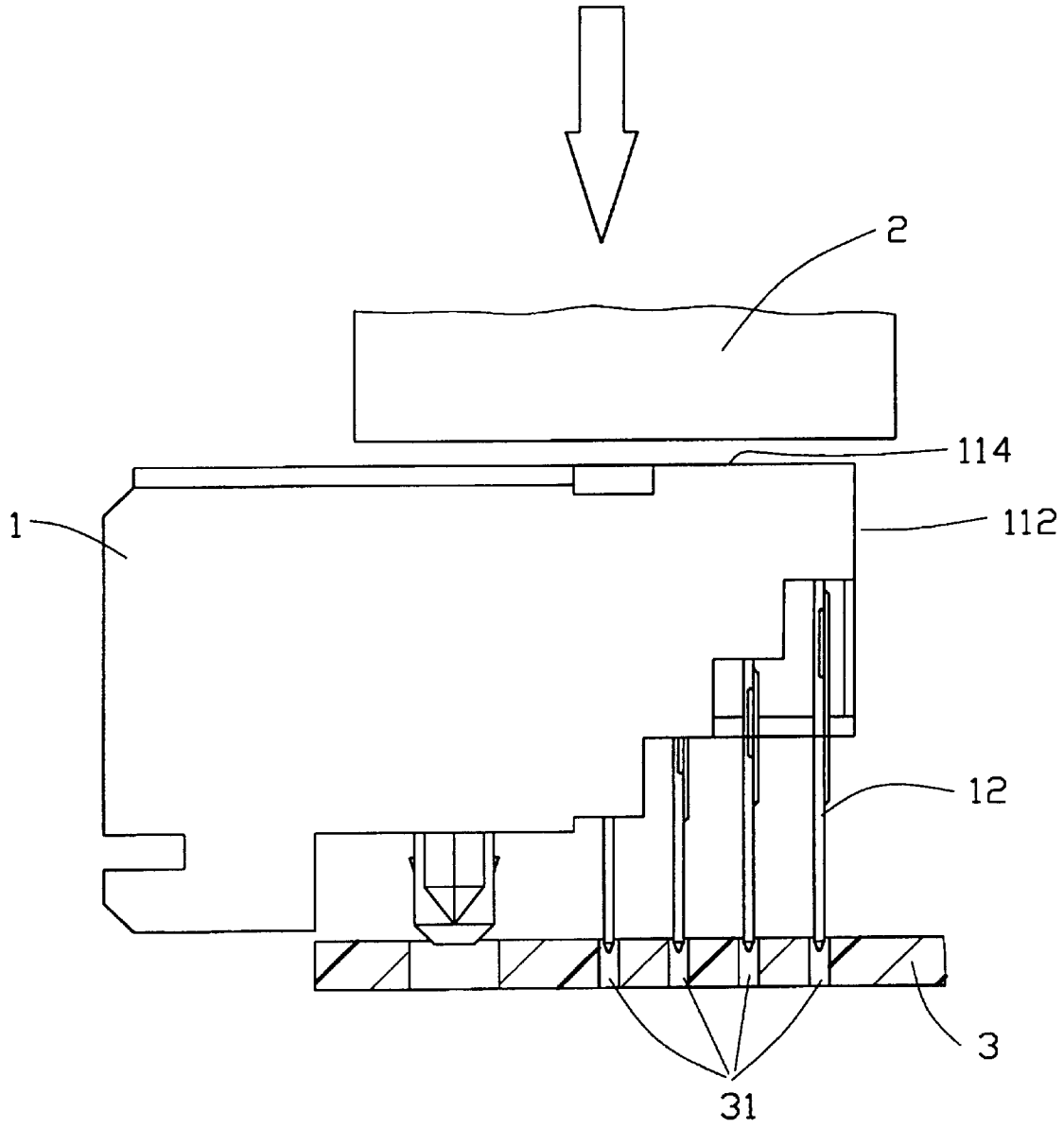
FIG.2A (PRIOR ART)
FIG. 2A is a cross-sectional view of the conventional connector of FIG. 1 showing the connector being assembled to the PCB by means of the tool.
Figure 2B:
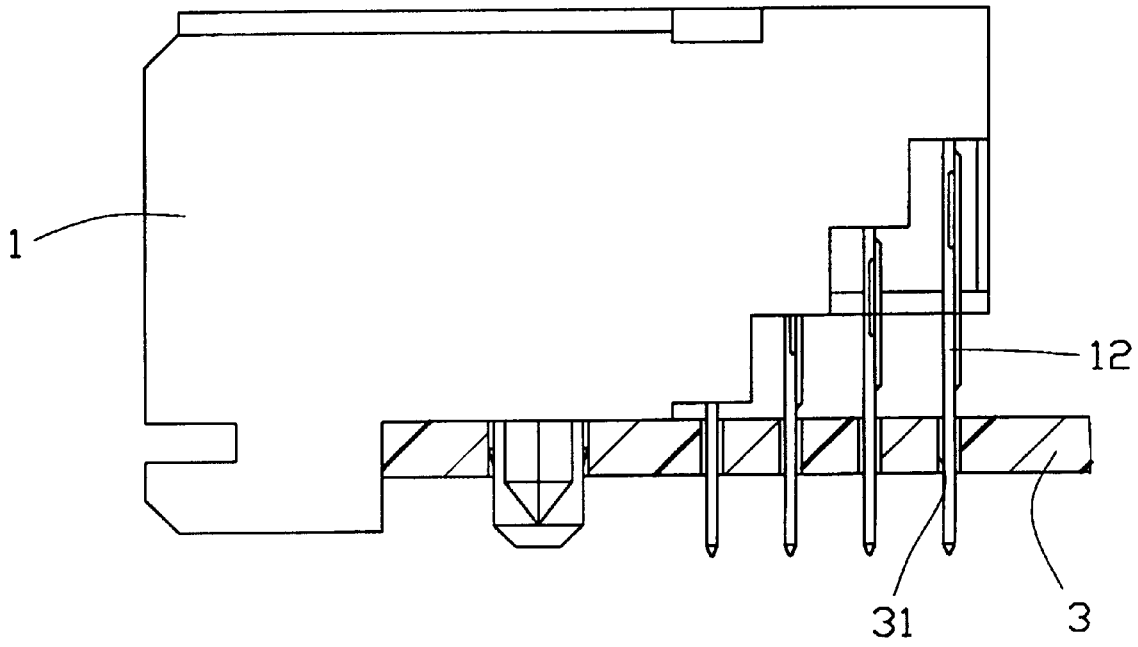
FIG.2B (PRIOR ART)
FIG. 2B is a cross-sectional view of the conventional connector of FIG. 1 showing the connector fully assembled to the PCB.
Figure 3:
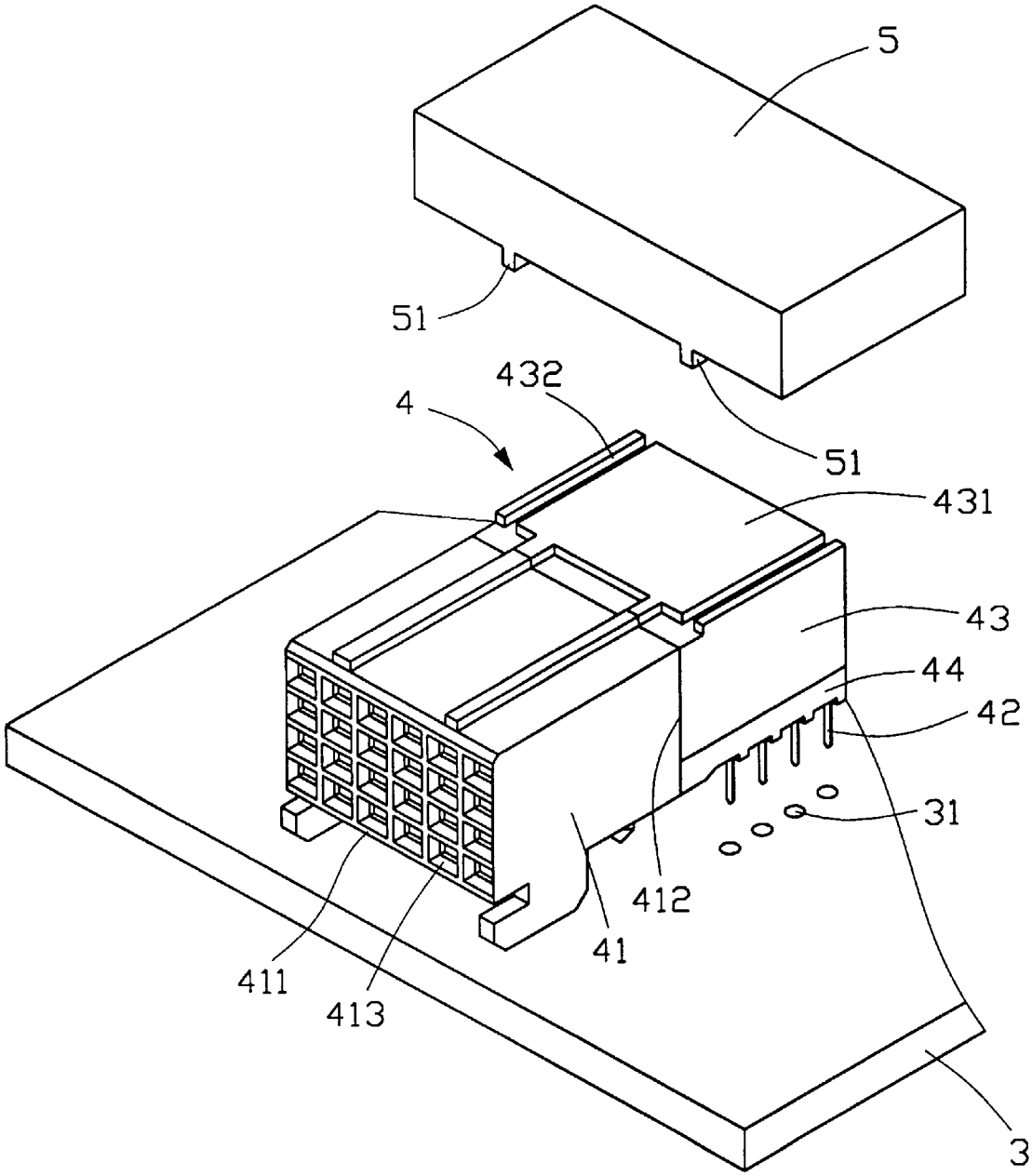
FIG. 3 is a perspective view of a high pin density connector and an external tool in accordance with a preferred embodiment of the present invention.

Referring to FIG. 3, a high pin density connector 4 in accordance with the present invention includes an insulative housing 41 having a mating face 411, a mounting face 412, and a plurality of passageways 413 defined therebetween. A plurality of contacts 42 are received in the passageways 413 and extend downward beyond a lower face of the housing 41 for an interferential engagement with holes 31 defined in a PCB 3. Tail portions (not labeled) of the contacts 42 extend through a spacer 44 for increasing the rigidity thereof. A positioning block 43 is attached to the mounting face 412 of the housing 41 and the spacer 44.

The positioning block 43 forms a bearing face 431 for receiving a force from an external tool 5 for facilitating insertion of the contacts 42 into the corresponding holes 31 of the PCB 3. Guiding means (not labeled) comprises two grooves 432 defined in the bearing face 431 of the positioning block 43 and ribs 51 formed on a bottom face of the tool 5.

Figure 4A:
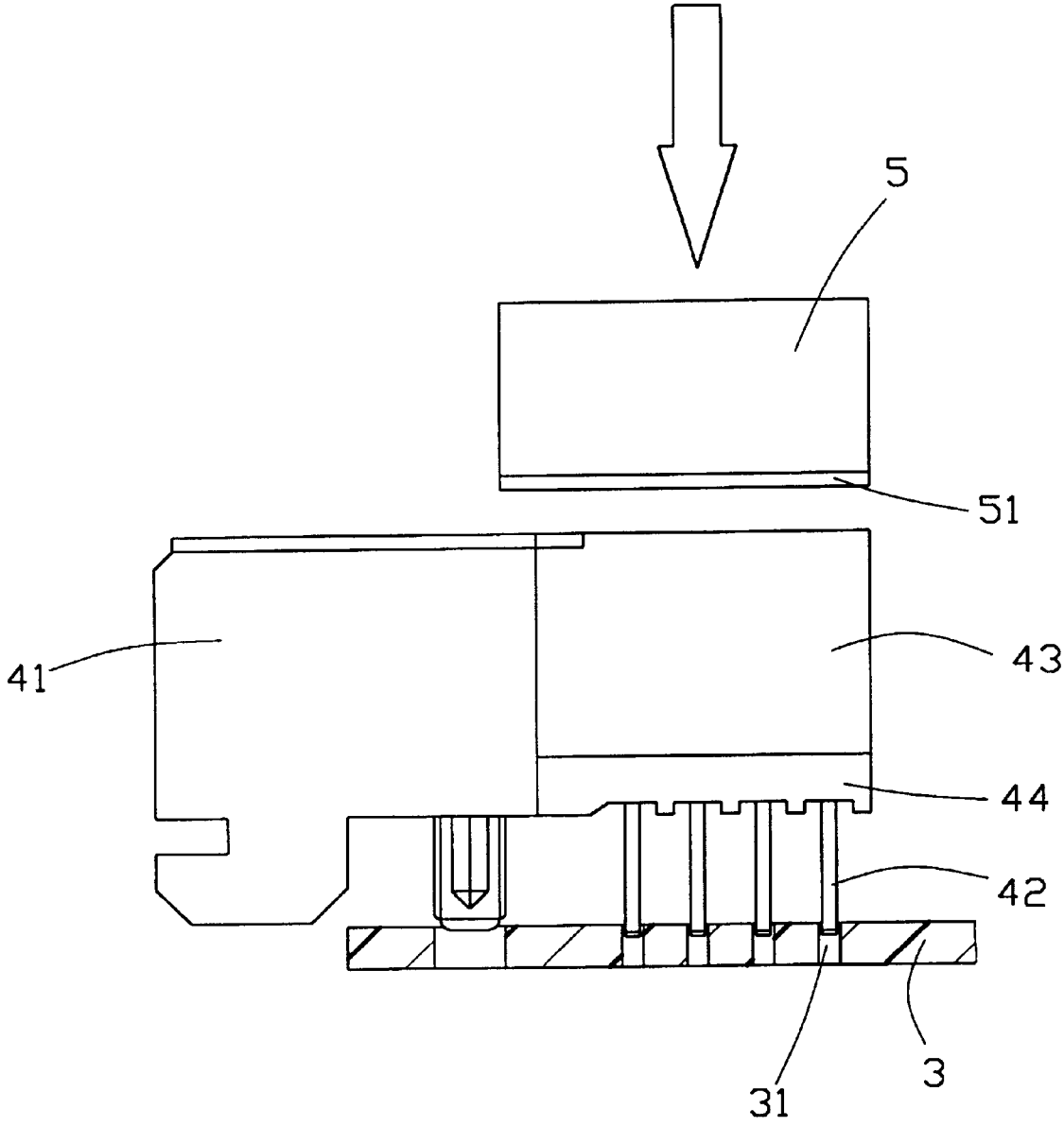
FIG. 4A is a side view of the connector of FIG. 3 showing the connector being inserted into a PCB by means of the tool.
Figure 4B:
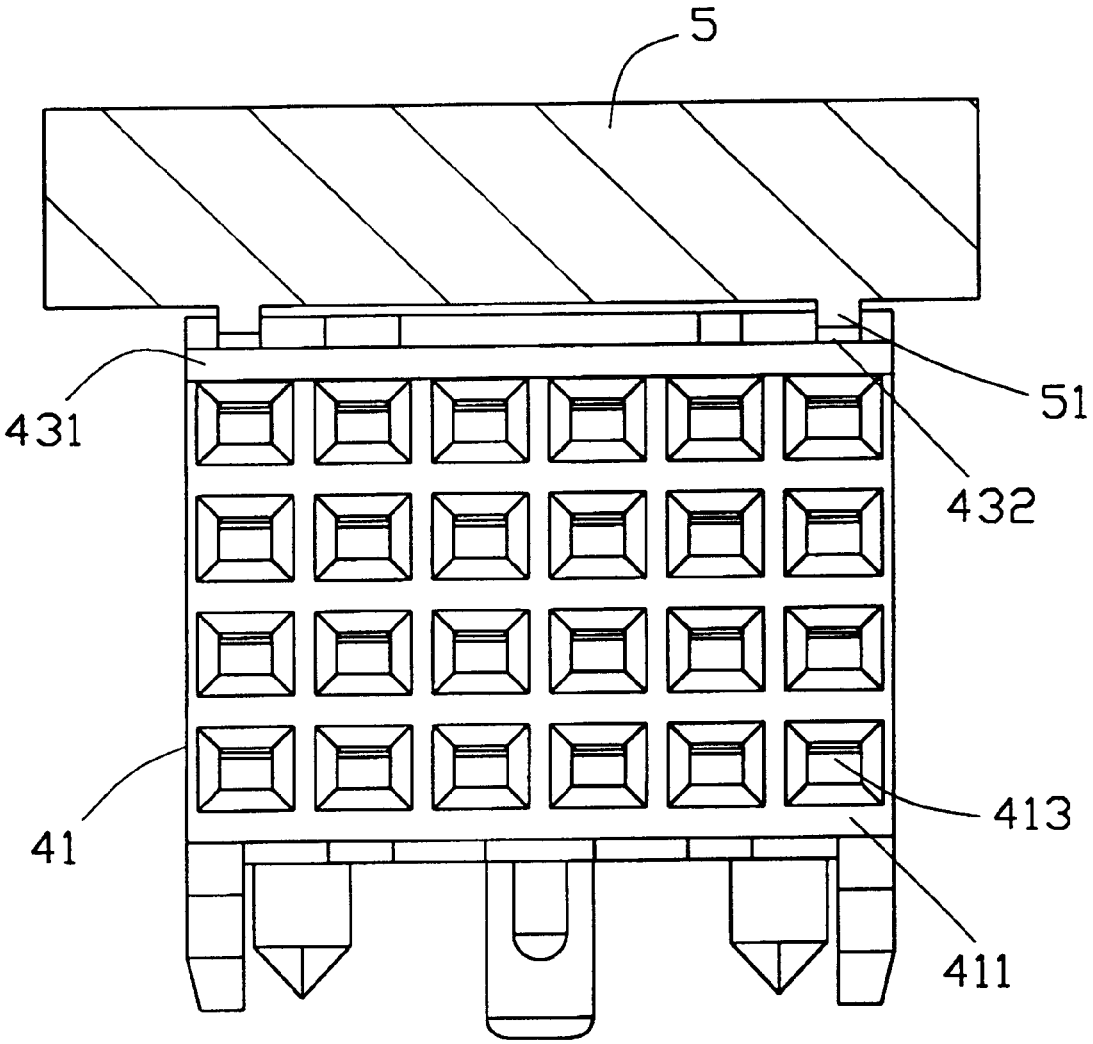
FIG. 4B is a front view of FIG. 4A.

Referring to FIGS. 4A and 4B, the tail portions of the contacts 42 of the connector 4 are aligned with the holes 31 of the PCB 3. The tool 5 engages with the positioning block 43 by inserting the ribs 51 into the corresponding grooves 432. The height of the ribs 51 is less than the depth of the grooves 432 whereby the entire rib 51 will be received within the corresponding groove 432. When a user exerts a force on the tool 5 in the direction of the arrow shown in FIG. 4A, the force is evenly distributed across the bearing face 431 whereby all of the contacts 42 are properly received in the corresponding holes 31 of the PCB 3.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A combination of a high pin density connector and a tool for facilitating an assembly of the connector to a printed circuit board, including:

a connector comprising:

an insulative housing having a mating face, a mounting face, and a plurality of passageways defined therebetween;

a positioning block attached to the mounting face of the housing and forming a bearing surface, the bearing surface defining two grooves; and a plurality of contacts received in the passageways and extending beyond a bottom face of the positioning block for an interferential engagement with holes defined in a PCB; and a tool used for providing a force on the positioning block to facilitate insertion of the contacts into the holes of the PCB, said tool forming a pair of ribs on a bottom face thereof for engaging with corresponding grooves in the bearing surface of the positioning block;

whereby when the contacts of the connector are aligned with the holes of the PCB, the tool engages with the positioning block, and when a user exerts a force on the tool, the force is evenly distributed whereby all of the contacts are evenly received in the corresponding holes of the PCB.

2. The combination as described in claim 1, wherein the height of the ribs is less than the depth of the grooves whereby the entire rib will be received within the corresponding groove when the tool engages with the positioning block.

3. The combination as described in claim 1 further comprising a spacer attached to a bottom face of the positioning block and receiving tail portions of the contacts therein for increasing the rigidity thereof.

4. A combination of a connector and a tool for activating the connector to be correctly mounted to a printed circuit board, comprising:

a connector including:

an insulative housing defining a mating face and a lower face, and enclosing a plurality of contacts each of which extends toward said mating face and said lower face at two ends thereof;

a positioning block positioned on a back portion of the housing for aligning the contacts with corresponding holes in the printed circuit board;

a tool for providing a force on the connector for facilitating insertion of the contacts into the corresponding holes of the printed circuit board; and means for providing engagement between the tool and the connector thereby preventing lateral relative movement therebetween, the means consisting of at least one rib and groove respectively provided on the tool and the positioning block, the rib and the groove being engageable with each other.

* * * * *